United States Patent [19]

Green

[11] Patent Number: 4,473,929

[45] Date of Patent: Oct. 2, 1984

[54] MAGNETICALLY CUSHIONED CLOTH TENTERING DEVICE

[76] Inventor: Sanford M. Green, 2916 NW. 55th Ave., Lauderhill, Fla. 33313

[21] Appl. No.: 389,398

[22] Filed: Jun. 17, 1982

Related U.S. Application Data

[63] Continuation-in-part of Ser. No. 255,330, Apr. 17, 1981, abandoned, which is a continuation of Ser. No. 969,670, Dec. 15, 1978, abandoned.

[51] Int. Cl.[3] ..... D06C 3/10; D06C 5/00

[52] U.S. Cl. ..... 26/80; 26/96

[58] Field of Search ..... 26/80, 83, 84, 85, 89, 26/95, 96; 335/303, 306

[56] References Cited

U.S. PATENT DOCUMENTS

| | | | |
|---|---|---|---|
| 2,517,067 | 8/1950 | Wedler | 26/80 |
| 2,623,263 | 12/1952 | Dungler | 26/84 |
| 2,795,243 | 6/1957 | Strazzeri | 26/80 X |
| 3,217,361 | 11/1965 | Ryan et al. | 26/85 X |
| 3,334,391 | 8/1967 | Kusters et al. | 26/83 |
| 3,922,765 | 12/1975 | Hogendyk | 26/80 |
| 3,978,557 | 9/1976 | Goodson | 26/84 |

FOREIGN PATENT DOCUMENTS

| | | | |
|---|---|---|---|
| 2106455 | 8/1972 | Fed. Rep. of Germany | 26/80 |
| 465277 | 2/1971 | Japan | 26/85 |

*Primary Examiner*—Robert Mackey

*Attorney, Agent, or Firm*—Richard M. Saccocio

[57] ABSTRACT

A cloth tentering device wherein the tentering force for spreading cloth is produced magnetically between a permanent magnet member accommodated within a tubular cloth or engaged with the selvages of a flat cloth and rows of electromagnets in position separate from and parallel to the cloth. The tentering force can be freely adjusted in the course of the tentering operation by controlling the energizing current of the electromagnets.

9 Claims, 7 Drawing Figures

MAGNETICALLY CUSHIONED CLOTH TENTERING DEVICE

This is a continuation in part application of application Ser. No. 255,330, filed Apr. 17, 1981, now abandoned, which in turn is a continuation of application Ser. No. 969,670, filed Dec. 15, 1978, now abandoned.

BACKGROUND OF THE INVENTION

1. Field of the Invention

The present invention relates to a tentering device, and more particularly to a tentering device wherein the spreading width of a cloth can be easily changed during the cloth spreading process without need of stopping the equipment in use.

2. Description of the Prior Art

Heretofore, various types of tentering devices have been used with the aim of spreading cloth to a predetermined width thereby to obtain products of uniform quality.

One such type of tentering device is the clip-type spreading device or the pin-tenter device which has clamps or pins mounted on each of a pair of generally parallel side chains. These clamps or pins clamp or hook the opposite selvages of a cloth fed from a feeding roller so that the cloth is spread to a predetermined width as the clamps or pins are moved and guided by the side-chains. The cloth spreading width is predetermined by setting the distance between the side chains on which the clamps or pins are mounted. Such prior art devices cannot immediately vary the spreading width in the course of the cloth spreading process. Since the side-chains and hence the pins or clamps cannot move in the defective portion, for example, a narrow portion in the cloth to be tentered, the narrow portion is overstretched with the frequent result that it is torn.

Another type of tentering device is the calendar machine. The calendar machine is constructed in such manner that a cloth of, for example, tubular configuration, passed between heated rollers is thereafter passed over a fixed width spreader of, for example, U-shaped configuration. That is to say, in use, the spreader is inserted into the tubular cloth. As with the aforementioned clip-type or pin-type spreading device, this type of tentering device is adjusted for spreading width prior to use and therefore cannot be immediately varied in spreading width in the course of the spreading process. Moreover, the device overstretches narrow portions of the cloth and, in extreme cases, causes the cloth to tear.

SUMMARY OF THE INVENTION

The present invention aims at providing a new type of tentering device which overcomes the problems inherent in the conventional devices described above and which permits free and easy adjustment of the spreading width in the course of the spreading process and, moreover, which automatically reduces the spreading width at narrow portions of the cloth so as to prevent overstretching and tearing.

Various other objects, advantages and features of the invention will become apparent to those skilled in the art from the following discussion taken in conjunction with the following drawings, in which:

DESCRIPTION OF THE PREFERRED EMBODIMENTS

Preferred embodiments of the tentering device of the present invention will now be described with reference to the attached drawings.

Figure 1:
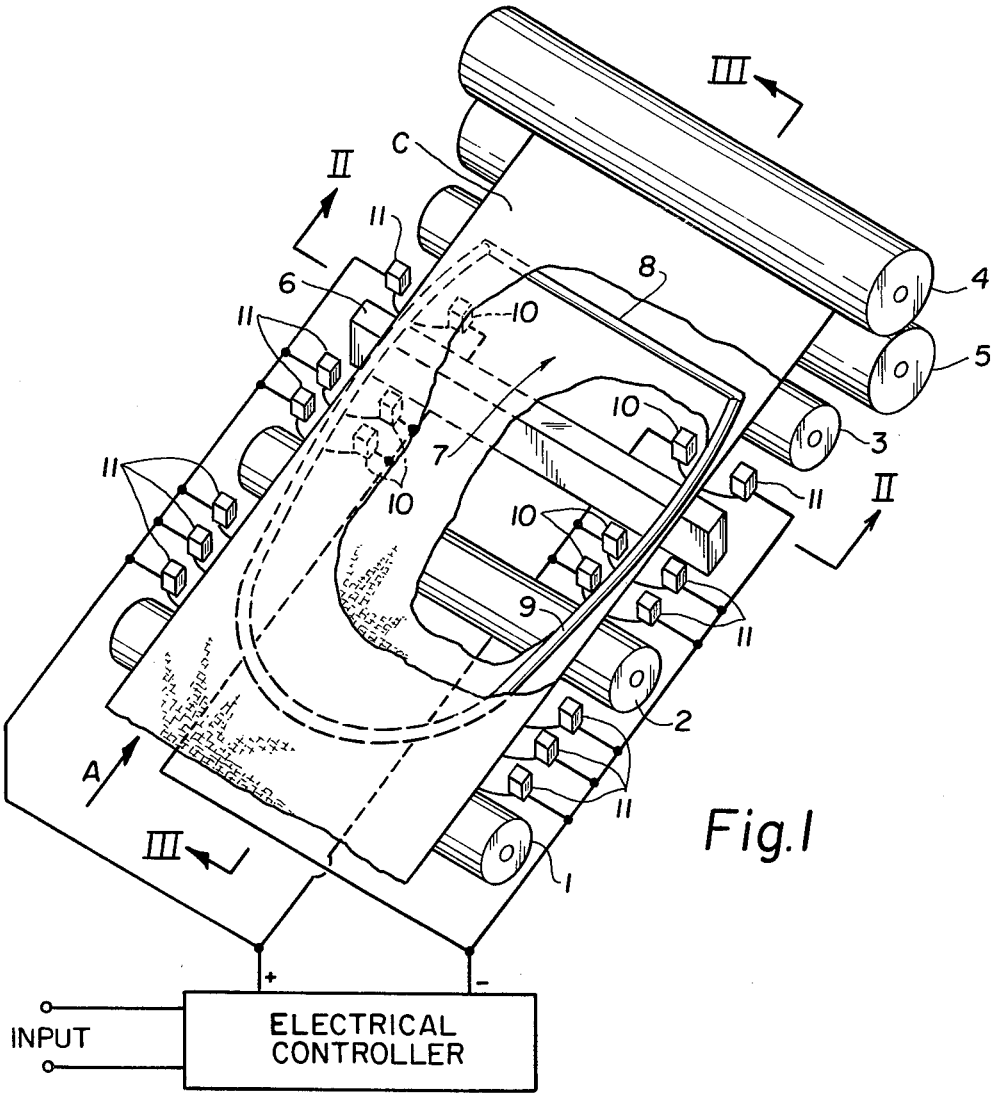
FIG. 1 is a perspective schematic view of a tentering device for a tubular cloth tentering machine according to the present invention.
Figure 2:
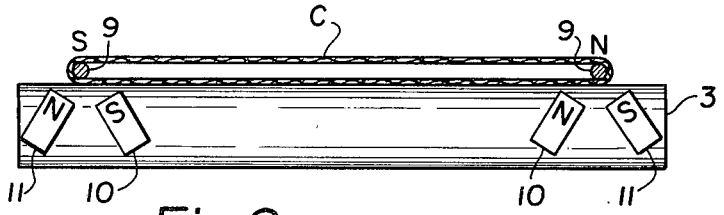
FIG. 2 is a sectional view taken along the line II—II of FIG. 1.
Figure 3:
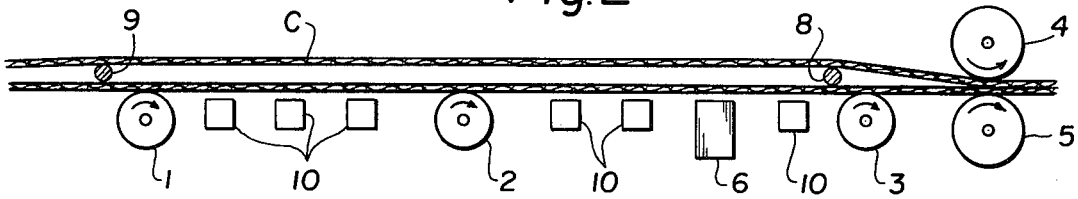
FIG. 3 is a sectional view taken along line III—III of FIG. 1.

Referring to FIGS. 1 to 3, there is shown in schematic form a tubular cloth calendering device according to the present invention. A tubular cloth C is fed over supporting rollers 1, 2 and 3 in the direction of the arrow A to a pair of feeding rollers 4, 5 of a calendering machine. A steam supply unit 6 for blowing steam over the entire width of the cloth C is located between the supporting rollers 2 and 3. A spreading member 7 is accomodated within the tubular cloth C and is supported on the supporting rollers 1, 2 and 3.

Figure 4:
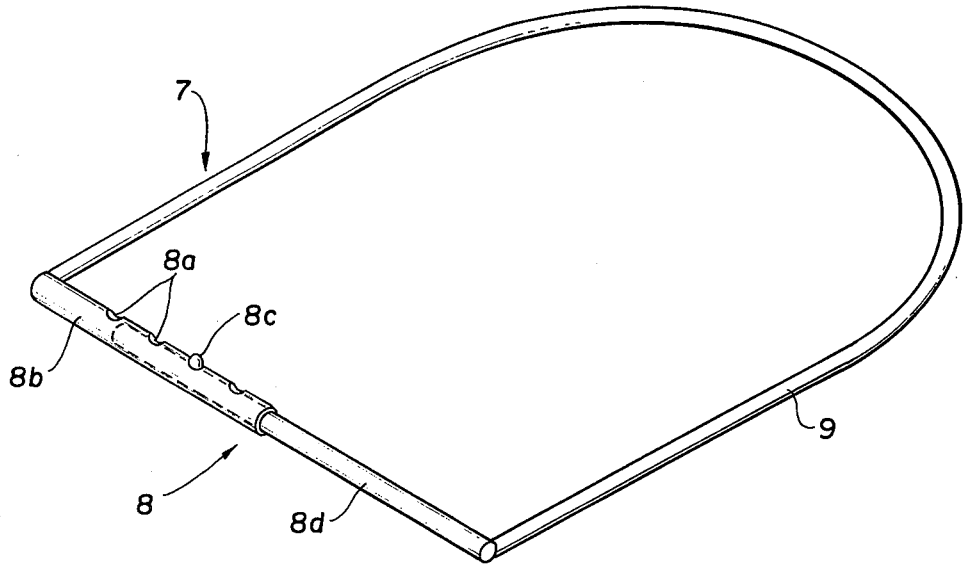
FIG. 4 is a perspective view of the spreading member of FIG. 1.

The purpose of the spreading member 7 is to spread the cloth C to a prescribed width before it passes between the feeding rollers 4 and 5. As shown in FIG. 4, the spreading member 7 consists of a rod member 8 of adjustable length and U-shaped flexible member 9, the ends of which are connected to the ends of the rod member 8 to form a closed loop. The rod member 8 consists of a sleeve member **8*b* provided with a member of holes 8*a* and an insertion member 8*d* insertingly held within the sleeve member 8*b* and possessing a spring-loaded projection 8*c* for engaging one of the holes 8*a*. Accordingly, by selecting the one of holes 8*a* with which the projection 8*c* engages, the length of the rod member 8 can be adjusted and, in this way, the spreading width is generally determined. Holes 8*a*, and projection 8*c* are rotated 90° in FIG. 4 for clarity. In actual practice, holes 8*a* and projection 8*c* preferably lie in the plane within member 9. The rod member 8 is made of a nonmagnetic material such as brass. On the other hand, the U-shaped flexible member 9** is, for example, made of a permanently magnetized spring.

A plurality of electromagnets 10 and 11 are, as shown in FIG. 1 to FIG. 3, arranged in rows under and parallel to the flexible member on the inside and outside thereof so as to magnetically interact with the permanently magnetized flexible member 9. The electromagnets 10 positioned inside the flexible member are of the same polarity as the polarity of the portion of the flexible member which they face and act to repel the flexible member. On the other hand, the electromagnets 11 positioned outside the flexible member are of opposite polarity to the polarity of the portion of the flexible member which they face and act to attract the flexible member. For example, in FIG. 1 and FIG. 2, if the permanently magnetized flexible member 9 is magnetized to have its right side portion as the N-pole and its left side portion as the S-pole, then the poles of the electromagnets facing the flexible member are the N-poles for the electromagnets 10 on the right inside, the S-poles for the electromagnets 11 on the right outside, the S-poles for the electromagnets 10 on the left inside, and the N-poles for the electromagnets 11 on the left outside. As a result of the arrangement of the magnets in this relationship, the flexible member of the cloth spreading member receives from the electromagnets a composite magnetic force in directions causing it to spread and, as a result, the tubular cloth C in which the spreading member is accommodated is spread by the widthwise force received as a result of the stretching force in the direction of width of the flexible member. What is more, this stretching force can be freely adjusted by controlling the electromagnetic force of the electromagnets 10 and 11, i.e. by controlling the amount of their energizing current. The energizing current to the electromagnets are controlled by a controller of any well known type as schematically shown in FIG. 1. The controller or control means controls the electric current to control the magnetic output force.

For this purpose, the electromagnets 10 and 11 are controlled of their energizing current by, for example, a rheostat or other appropriate control device (not shown) connected directly to a direct current source. Accordingly, as is well known, if the energizing electric current is made large, the repulsive force between the electromagnets 10 and the flexible permanent magnet 9 and the attractive force between the electromagnets 11 and the flexible permanent magnet 9 will become large and the stretching force acting on the tubular cloth C will be increased. Thus, in the spreading process, it is possible to freely adjust the spreading width by controlling the stretching force. Moreover, as the spreading is conducted under a balanced state between the magnetic stretching force produced by the electromagnets and the permanent magnet and the counterforce of the tubular cloth C, the tubular cloth C is safe from tearing when a narrow section thereof reaches the spreading member because this will increase the counterforce of the tubular cloth C and reduce the distance across the flexible member of the spreading member.

Figure 5:
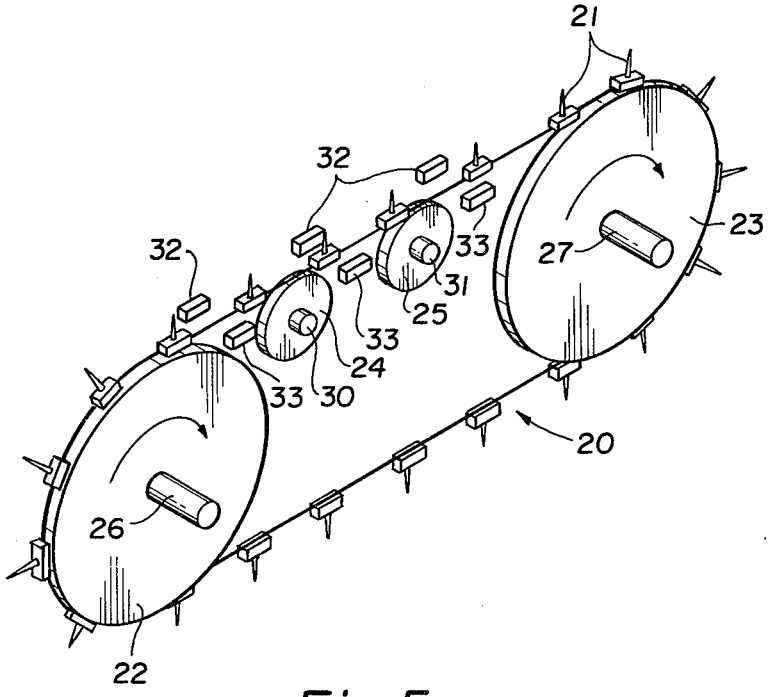
FIG. 5 is a schematic view of the pin-clip chain on one side of a pin-tenter illustrating another embodiment of the present invention.

FIG. 5 is a schematic view of another embodiment of the pin-clip chain on one side of a pin-tenter device to which the present invention has been applied. This pin-clip chain 20 has a number of pins 21 attached at equal intervals therealong and is made of a magnetic material which is permanently magnetized in the direction crosswise to the length of the chain. The pin-clip chain 20 is engaged on a pair of drive sprockets 22 and 23 made of a nonmagnetic material and is guided by a plurality of guide sprockets 24 and 25. The sprockets 22 and 23 are respectively mounted on drive shafts 26 and 27 so as to be freely slidable thereon in the axial direction, and the guide sprockets 24 and 25 are respectively rotatably mounted on shafts 30 and 31 so as to be freely slidable thereon in the axial direction. Electromagnets 32 and 33 are provided respectively on the inner and outer sides along the upper part of the pin-clip chain 20 at positions falling between the sprockets 22, 24, 25 and 23, with the electromagnets 32 on the inside exerting a repulsive force on the permanently magnetized pin-clip chain 20 and the electromagnets 33 on the outside exerting an attractive force on the permanently magnetized pin-clip chain 20.

As consequence, a flat cloth which has had its selvages brought into engagement with the pins 21 of the chains 20 at a position above the sprockets 22 by a tenter engagement means (not shown) is, in the process of carrying out tentering, subjected to a stretching force which, in the same manner as in the embodiment in FIG. 1, can be freely adjusted by controlling the energizing electric power of the electromagnets 32 and 33, and, even in the case of a narrow section of cloth, the tearing of the cloth by excessive stretching force will be prevented by the movement of the sprockets 22, 24, 25 and 23 along their axes in the widthwise direction at the time such section moves across the pin-clip chain.

Figure 6:
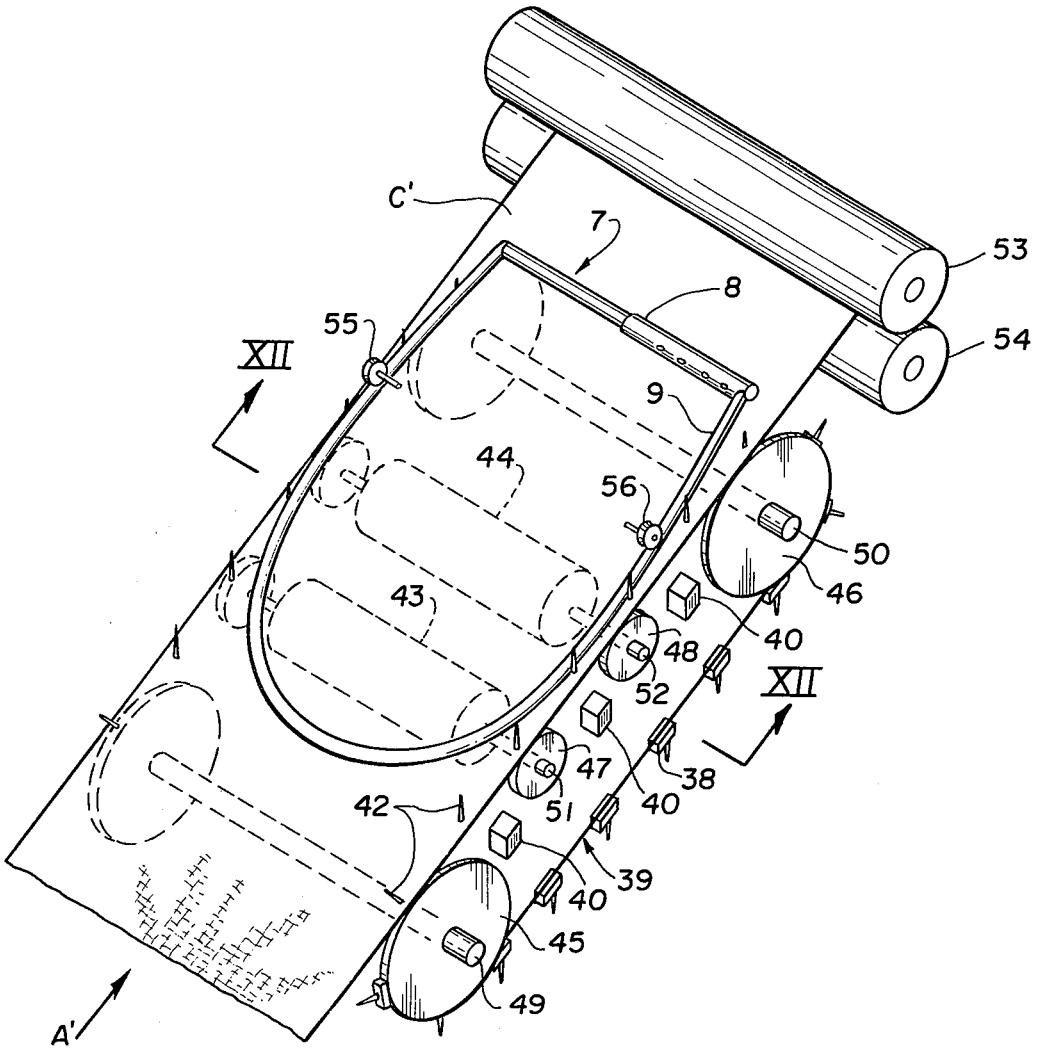
FIG. 6 is a schematic view of a pin-tenter illustrating still another embodiment of the present invention.
Figure 7:
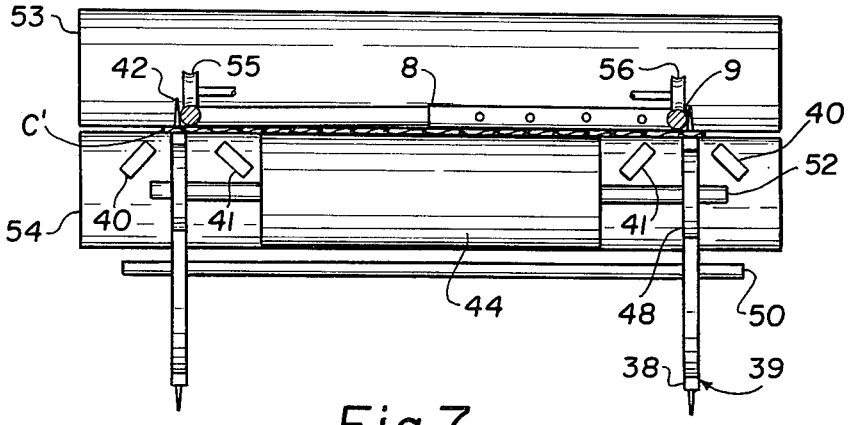
FIG. 7 is a sectional view taken along the line VII—VII of FIG. 6.

FIG. 6 is a schematic view of a pin-tenter device illustrating another embodiment of the present invention. In this embodiment, spreading member 7 and the magnets 10 and 11 of the embodiment shown in FIG. 1 are applied to nontubular or flat cloth C'. The inventive method of tentering flat cloth is substantially the same as tentering tubular cloth which embodiments are depicted in FIGS. 7 and 1, respectively. That is, spreading member 7 is acted upon by the controllable magnetic force created by electromagnets 40 and 41 which in turn spreads the cloth. In the embodiment of FIG. 1, the tubular form of the cloth is used to apply the spreading force; in the embodiment of FIG. 6, pins 42 through the edges of flat cloth C' are used to apply the spreading force.

Still referring to FIG. 6, cloth C' is fed over supporting rollers 43 and 44 of a tentering machine in the direction of arrow A'. Although not shown for purposes of simplicity and clarity, a steam supply unit blows steam over and through the entire width of cloth C'. The application of steam to cloth C' is, of course, at a location where it best serves to set cloth C' while being spread. Pin-clip chain 39 has a plurality of pins 42 attached thereto at approximately equal intervals therealong. Pins 42 are attached to blocks 38 which serve to provide further support to the edges of cloth C' and limit the engagement of pins 42 within cloth C'. Pin-clip chain 39 is engaged to a pair of drive sprockets 45 and 46 and is guided by guide sprockets 47 and 48. Sprockets 45, 46, 47 and 48 are respectively mounted on shafts 49, 50, 51 and 52 so as to be freely slidable thereon in an axial direction. Electromagnetics 40 and 41 are provided respectively on the inner and outer sides along the upper part of pin-clip chain 43 at appropriate positions between sprockets 45, 46, 47 and 48.

Referring also to FIG. 7, spreading member 7 is placed on top of cloth C' with rod member 8 positioned parallel to rollers 53 and 54 which may be idling rollers. Rollers 53 and 54 serve a primary purpose of maintaining the position of spreading member 7 along the length of cloth C'. Thus, as frame member 7 attempts to move along with cloth C', bar member 8 is constantly being pushed in a direction opposite to that of cloth C' by rollers 53 and 54. Roller 54 may be replaced by a nonrolling member such as the table of the machine without detracting from the function of roller 53. Flexible member 9 (comprising a permanently magnetized spring) of spreader 7 is placed between pins 42 on opposite sides of cloth C' as shown in FIG. 7. Pins 42 thus retain spreader in position along the width of cloth C'. In this regard, pins 42 are of sufficient height above cloth C' so as to retain spreader 7. The polarity of flexible spring member 9 and electromagnets 40 and 41 are, as previously explained, in the embodiment of FIG. 1 with electromagnets 40 and 41, respectively, replacing electromagnets 11 and 10. In this manner, cloth spreading member 7 is acted upon by composite magnetic forces in a direction causing it to spread. The bearing pressure of flexible spring member 9 against pins 42 causes tentering of cloth C'. The ability of sprockets 45, 46, 47 and 48 to freely slide on their respective shafts coincides with the movement of flexible spring member 9. Since cloth C' is attached to pins 42, cloth C' spreads in accordance with the widthwise movement of pins 42 which, as previously explained, is controlled by flexible spring member 9.

Any tendency of spreading member 7 to lift off cloth C' during spreading of cloth C' is counteracted by the weight of spreading member 7. Should there be a further need to prevent lift of spreading member 7, axially slidable rollers 55 and 56 may be employed. Of course, rollers 55 and 56 must engage the top of flexible spring member 7 without interfering with pins 42. Rollers 55 and 56 may be spring supported by the tentering machine in any well known manner.

The control of electromagnets 41 and 42 may be controlled as per the controller circuit as previously explained.

As an alternative to utilizing a permanently magnetized pin-clip chain 20, pins 21 and the blocks to which they are attached may be made of a permanently magnetized material. Indeed, in a further alternative, sprockets 24 and 25 may be made of a permanently magnetized material. Of course, with these alternatives, the shown positions of electromagnets 32 and 33 would require adjustments so as to properly act upon the permanently magnetized members.

It is to be noted that the inventive apparatus and method may be used with equal results on a tentering machine utilizing clips in lieu of pins. With this type of machine, the chain member to which the clips are attached may be made of a permanently magnetized material and the embodiment of FIGS. 6 and 7 may be adapted to accommodate the clips in lieu of the pins by utilizing the teachings shown, described and claimed herein.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. A tentering device adapted to spread an elongated strip of cloth having two longitudinal edges, said cloth moving on the tentering device in a direction parallel to the longitudinal edges of said cloth, comprising magnetized means supported by said tentering device, for applying tentering forces to said cloth, means for connecting said magnetized means to each longitudinal edge of said cloth, means attached to said tentering device comprising electromagnets with first electromagnets positioned adjacent the outboard side of each longitudinal edge of said cloth and second electromagnets positioned adjacent the inboard side of each longitudinal edge of said cloth with each of said first electromagnets producing a magnetically attractive force to said magnetized means and with each of said second electromagnets producing a magnetically repulsive force to said magnetized means.

2. The tentering device of claim 1, wherein said cloth is tubular and said magnetized means comprises a generally U-shaped member having flexible magnetized sides, with said U-shaped member fitting within said tubular cloth and said means for connecting said magnetized means to each longitudinal edge of said cloth comprises each side of said U-shaped member fitting against each closed side of said tubular cloth.

3. The tentering device of claim 2, including a pair of transversely mounted rollers connected to said tentering device, the upper and lower surfaces of said tubular cloth converging at the entrance of said rollers and passing flatly therebetween, and said magnetized U-shaped member includes a bar positioned across the ends thereof, said bar being positioned up against said converging surfaces of said cloth.

4. The tentering device of claim 1, wherein said cloth is flat and said magnetized means comprises a magnetized flexible belt mounted on each longitudinal edge of said cloth on a pair of sprockets rotationally mounted on said tentering device, and said means for connecting said magnetized means to each longitudinal edge of said cloth comprises a plurality of pins substantially perpendicularly mounted on each of said belts at spaced locations thereon, said pins on the upper side of each of said belts fitting through each of the longitudinal edges of said cloth.

5. The tentering device of claim 4, wherein each of said sprockets are slidingly engaged on axles in a direction transverse to the longitudinal direction of said cloth, said axles being mounted on said tentering device.

6. The tentering device of claim 1, wherein said cloth is flat and said magnetized means comprises a generally U-shaped member having flexible magnetized sides and said means for connecting said magnetized means to each longitudinal edge of said cloth comprises a pair of flexible belts, each belt being arranged parallel to each longitudinal edge of said cloth and positioned on a pair of spaced sprockets, said sprockets being rotationally mounted on axles connected to said tentering device, and means for attaching each of said belts to each longitudinal edge of said cloth, with said sides of said magnetized means fitting against said means for attaching the belts to the longitudinal edges of the cloth.

7. The tentering device of claim 6, wherein said means for attaching each of said belts to each longitudinal edge of said cloth comprises a plurality of pins perpendicularly mounted on each of said belts at spaced locations thereon, said pins on the upper side of each of said belts fitting through each of the longitudinal edges of said cloth.

8. The tentering device of claim 6, including a bar across the ends of said U-shaped member, at least one roller transversely mounted on said tentering device with said flat cloth passing between said at least one roller and said bar being positioned against the surface of said at least one roller.

9. The tentering device of claim 6, wherein each of said sprockets are slidingly engaged on said axles in a direction transverse to the longitudinal direction of the said cloth.

* * * * *